US005085833A

United States Patent [19]

Mitsuhisa

[11] Patent Number: 5,085,833

[45] Date of Patent: Feb. 4, 1992

[54] LIQUID DRAIN TRAP DEVICE

[75] Inventor: Yukio Mitsuhisa, Yokohama, Japan

[73] Assignee: Tosoh Corporation, Yamaguchi, Japan

[21] Appl. No.: 243,347

[22] Filed: Sep. 12, 1988

[30] Foreign Application Priority Data

Sep. 11, 1987 [JP] Japan ..... 62-227755

[51] Int. Cl.[5] ..... B01D 19/02

[52] U.S. Cl. ..... 422/99; 422/101; 137/170.4; 137/205; 55/178; 141/65

[58] Field of Search ..... 422/99, 101; 137/205, 137/170.1, 170.4; 55/178, 185, 186, 192, 193; 141/65

[56] References Cited

U.S. PATENT DOCUMENTS 4,120,816 10/1978 de Lautrec et al. ..... 55/178

FOREIGN PATENT DOCUMENTS 1151429 5/1969 United Kingdom ..... 137/205

OTHER PUBLICATIONS

Dziewiecki et al., Chemical Abstract #94(12)86495r of Polish Patent #106,273 (12/31/79).

*Primary Examiner*—David L. Lacey
*Assistant Examiner*—William H. Beisner
*Attorney, Agent, or Firm*—Sughrue, Mion, Zinn Macpeak & Seas

[57] ABSTRACT

A liquid drain trap device of negative-pressure relay type, which comprises a vertically-elongated hollow container, a liquid drain pipe connected to the side wall of the container and negative-pressure suction device provided in an upper side of the container so as to maintain the interior of the container under a negative pressure and exert a suction force to drain the liquid through the pipe, the liquid drain pipe being made of fluorine resin material at least at its end section projecting into the interior of the container.

4 Claims, 3 Drawing Sheets

LIQUID DRAIN TRAP DEVICE

BACKGROUND OF THE INVENTION

1. Field of the Invention

The present invention relates to a liquid drain trap device to be used for any liquid drain piping in any biochemical analysis or other chemical analysis processing system, particularly a trap device which can be advantageously used to separate a liquid from a vacuum-sucked air therein in a piping system for drainage of a liquid such as cleaning solution, for example, used for a B/F (bound/free) separation for immunological analysis.

2. Description of the Related Art

In the biochemical analysis or any other type of chemical analysis, solutions such as reagents in reaction vessels have been conventionally removed by cleaning the vessels.

Such a cleaning equipment of conventional type comprises a piping system for supplying a cleaning solution and a piping system for draining the cleaning solution. Especially, the piping system for drainage of cleaning solution conventionally comprises a trap unit as well as a solenoid valve for controlling the opening and closing of a cleaning solution drain piping, which are installed between a vacuum source such as vacuum (pressure reducing) system and the cleaning solution drain piping equipped with a nozzle pipe connected to a reaction or other vessel filled with a liquid to be drained, so as to drain the cleaning solution away from the reaction or other vessel through the trap unit by using the air suction provided by the vacuum source.

The vacuum source comprises a combination of a vacuum pump and a vacuum tank in general.

The trap unit of conventional type comprises a vertically-elongated hollow container for storing a cleaning solution to be drained and an air suction pipe connected between the top of the container and the above-described vacuum source so as to suck up the cleaning solution in the container and store it in the bottom part of the container by receiving a negative pressure (air suction pressure) supplied by the vacuum source, and to drain the cleaning solution off the bottom part of the vessel by means of a three-way valve when an adequate quantity of cleaning solution is stored in the bottom part of the container. More specifically the cleaning solution is drained by changing over the three-way valve so as to restore the pressure in the container to the atmospheric pressure and then opening the valve located at the lower portion of the container.

During the continuous operation, however, the above-described trap unit presents disadvantages as follows:

The above-described trap unit is designed so that it sucks up the cleaning solution by the air suction or negative-pressure action provided by the vacuum source. Therefore, the cleaning solution and air jet dashingly into the container of the trap unit through the nozzle pipe connected to the reaction or other vessel to inevitably form bubbles in the cleaning solution stored in the container with high possibility.

If such bubbles are produced, a liquid film is formed and grows in the interior of the container, and it is sucked gradually upward in the container under the air suction by the vacuum source until the liquid may enter into the vacuum source system through an air suction pipe. The liquid sucked in the vacuum source system may cause a detriment such as failure of the vacuum pump or other unit. Therefore, it is necessary to drain the liquid off in time by using any applicable means.

The conventional type of vacuum source system generally comprises a drain pipe connected to the vacuum tank and equipped with a drain valve to drain the vacuum tank of the cleaning solution stored therein by means of the drain valve in time, so as to prevent the cleaning solution from entering the vacuum pump as vacuum source.

However, the vacuum system which requires to drain the vacuum tank of the cleaning solution presents the inconvenience that the interior of the vacuum tank returns under the atmospheric pressure each time when the tank is drained, which requires an onerous operation to recover the predetermined negative pressure in the interior of the tank when the vacuum system is restarted, and a waiting time while the vacuum condition is created just after the restart of the vacuum system.

To reduce this inconvenience, it is possible to take measures such as increasing the capacity of the container in the trap unit to decrease the draining operations for the vacuum tank. However, this solution cannot eliminate the inconvenience that it takes a long time to recover the predetermined negative pressure in the interior of the tank after the restart of the system.

SUMMARY OF THE INVENTION

The present invention aims at eliminating the above-described problem found in the conventional type of trap units.

An object of the present invention is to provide a trap device wherein bubble size formed in a liquid introduced in a container of the trap device can become effectively small so as to reduce largely the possibility of the liquid, stored in said container of said trap device, entering into a negative-pressure suction system (especially a vacuum tank therein).

Another object of the present invention is to provide a practical type of trap device containing a container having a relatively small capacity easy to design.

DETAILED DESCRIPTION OF THE INVENTION

To attain the above-described objects, the liquid drain trap device according to the present invention is a negative-pressure relay type which comprises a vertically-elongated hollow container, a liquid drain pipe connected to the side wall of the container and negative-pressure suction means provided in an upper side of the container so as to maintain the interior of the container under a negative pressure and exert a suction force to drain the liquid through the pipe, the liquid drain pipe being made of fluorine resin material at least at its end section projecting into the interior of the container.

According to the present invention, the liquid drain pipe is made of fluorine resin material at least at the end section of the pipe, because as the result of this inventor's examinations on the pipe materials to prevent the production of bubbles in the liquid in the container as the body of the trap device according to the present invention, it was found that the use of a water-repulsible material for the pipe resulted in the repulsion of the pipe to the liquid and consequently a smaller size of bubbles produced in the liquid to limit the formation of a liquid film to be sucked upward in the interior of the container. It can be considered that the growth of bubbles produced in the interior of the container may be caused by the liquid sticking on the whole discharge port of the liquid drain pipe to produce a multi-dimentional action of discharge port diameter, discharge force, etc. If the liquid drain pipe was made of water-repulsible material, however, the above-described objects were successfully attained by the effects such as the prevention of the liquid from sticking on the whole discharge port of the liquid drain pipe, the elimination of bubbles on the surface of the liquid in the interior of the container, and the smaller size of bubbles even if produced.

As the material for the end section of the liquid drain pipe, projecting into the interior of the container as the body of the trap device according to the present invention to introduce the liquid in the container, fluorine resin is preferably employed in consideration of its characteristics such as resistance to chemicals. The fluorine resin may be, for example, ethylene tetrafluoride, ethylene trifluoride, copolymer of ethylene tetrafluoride and propylene hexafluoride, or polymer of vinylidene fluoride. The mounting position of the liquid drain pipe on the container depends upon the quantity of the liquid stored in the interior of the container in relation to the inner diameter of the container and other factors. However, the liquid drain pipe is generally mounted on the side wall of the container about 1/6 to ½ of the container interior height away from the ceiling part of the container interior. The inner diameter of the liquid drain pipe depends upon the capacity of the trap device and other factors. However, it is often about 0.8 to 2 mm in general, similar to the sizes for the conventional trap units.

In the present invention, it is sufficient for the liquid drain pipe connected to the container as the body of the trap device to have the surface of the opening at its end section alone covered with fluorine resin. The other portions of the pipe may be made of other materials. Therefore, a sleeve having a fluorine resin end section may be fitted on the end of the pipe made of other material (for example, stainless steel), or the whole pipe to be connected to the container may be made of fluorine resin.

The other components of the trap device than the liquid drain pipe of the above-specified material may be constructed in the known fashion. However, it is especially preferable to employ the designs that the inside wall part of the container against which the discharged liquid from the pipe strikes (generally the inside wall part of the container which faces the discharge port of the liquid drain pipe at the distance of about 5 to 30 mm) is made of the above-described fluorine resin material, that baffle plates which are also preferred to be made of fluorine resin, are placed in the interior of the container on the way of the vertical direction so as to vary (decrease) the horizontal section area of the container interior steeply and to prevent any produced liquid film from being sucked upward, and that the lower end part of an air pipe connected to the vacuum system through the top of the container is bent in the form of the letter J.

The container as the body of the trap device according to the present invention is generally cylindrical, but not limitative in form.

BRIEF EXPLANATION OF THE DRAWINGS

FIG. 2(*a*) is a frontal and vertically-sectional view showing the container. FIG. 2(*b*) is a cross-sectional view along the line A—A as shown in FIG. 2(*a*).

FIG. 3(*a*) is a plane view showing the baffle plate, and FIG. 3(*b*) is a side view showing the baffle plate.

DESCRIPTION OF THE PREFERRED EMBODIMENTS

Figure 1:
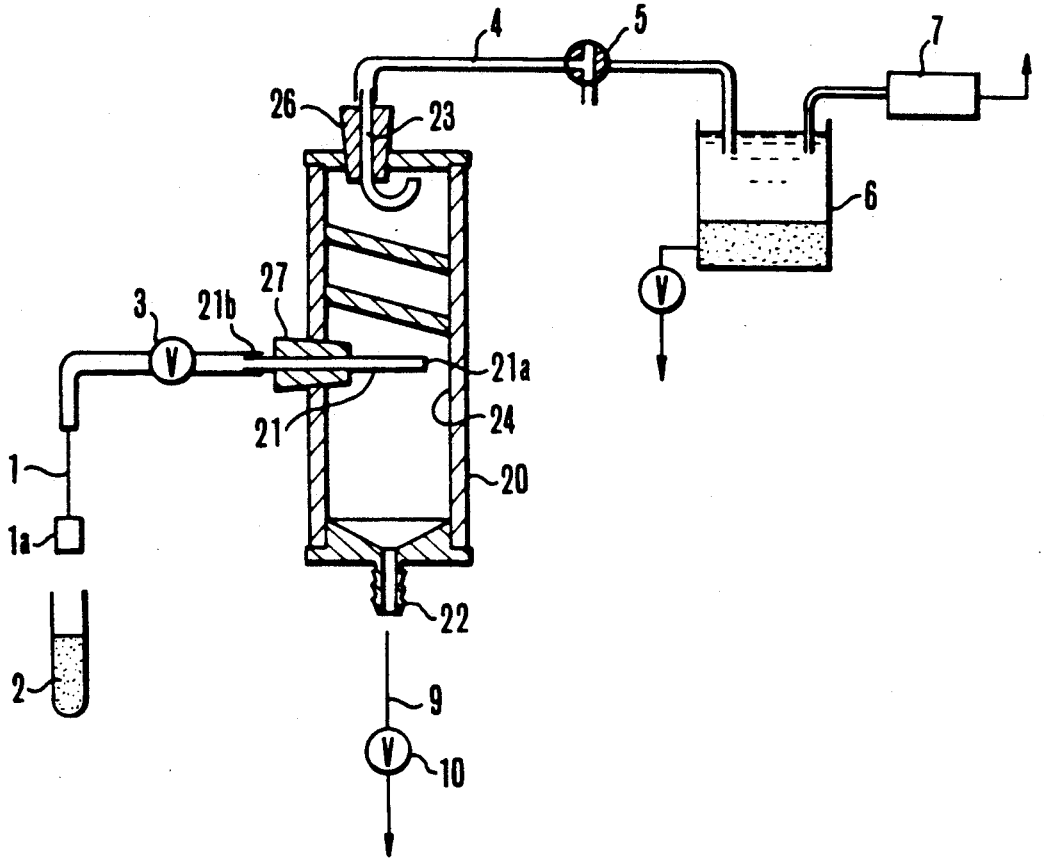
FIG. 1 is an illustrative view showing the configuration of a cleaning solution drain piping system comprising the cleaning solution drain trap device according to the present invention.
Figure 2A:
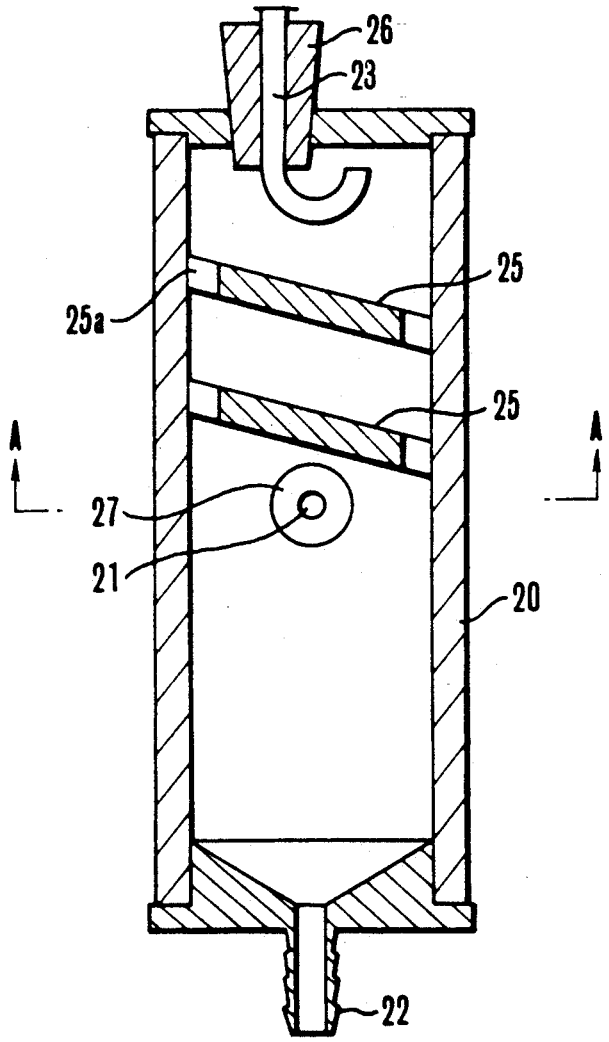
FIGS. 2 are enlarged views showing the container, the body of the trap means, as shown in FIG. 1.
Figure 2B:
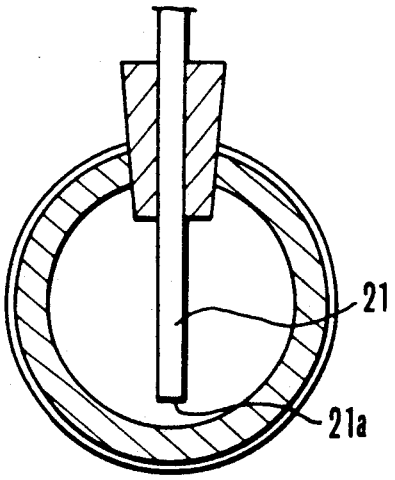

The embodiments according to the present invention will be described below with reference to the attached drawings.

In these figures, a nozzle 1*a* is connected to the end of a drain pipe 1 to be applied to a test tube 2 to be cleaned. The drain pipe 1 is provided with a drain control valve 3 on the way of its total length. The other end of the drain pipe 1 is connected to the external end 21*b* of a cleaning solution inlet pipe 21 connected to a container 20 as the body of the trap device according to the present invention. This container is made of acrylic resin, for example.

A vacuum tank 6 to supply a negative pressure into the container 20 is maintained by a vacuum pump 7 at the predetermined negative pressure, and connected to an air suction pipe 23 at the top of the container 20 through an air suction pipe 4 equipped with an air suction three-way control valve 5 on the way of the pipe length so as to maintain the interior of the container 20 at a negative pressure. A plug 26 fixes the top air suction pipe 23 connected to the container 20.

On the bottom of the container is mounted a connection 22 for a drain piping to drain the cleaning solution stored in the container 20. To the connection 22 is connected a drain piping 9 equipped with a drain valve 10.

In the above-described cleaning solution drain piping system, the trap device as shown in FIG. 1 is constructed as follows:

The container 20 as the body of the trap device according to the present invention comprises a cleaning solution inlet pipe 21 which is fitted in the wall of said container 20 and has an end section projected into the interior of the container 20. The open end 21*a* of the inlet pipe 21 faces the inside wall face 24 of the container 20 near thereto and above the upper limit level of the temporarily-stored cleaning solution.

Figure 3A:
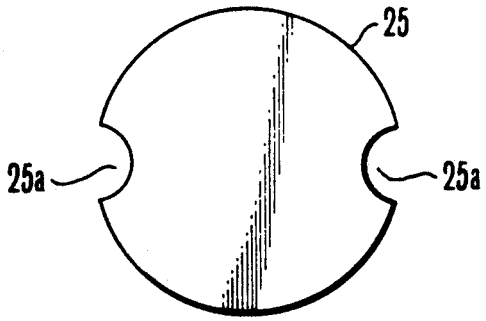
FIGS. 3 are views showing the baffle plate placed in the interior of the trap device.
Figure 3B:
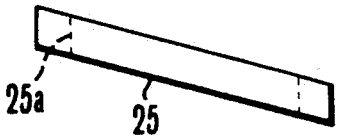

In the container 20, a limiting part which varies or decreases steeply the horizontal section area of the interior space in the container 20 is provided between the upper limit level of the stored cleaning solution and the air suction pipe 23 at the top of said container 20. In this embodiment, the limiting part that varies the horizontal section area steeply is provided by baffle plates 25 (see FIG. 3) placed about the vertically central position in the interior of the container 20. The baffle plate 25 is provided with openings 25*a*.

In this embodiment, the trap device thus constructed is characterized by the facts that the cleaning solution inlet pipe 21 connected to the drain pipe 1 is fitted in a hole formed in the side wall of the container 20, and fixed by a plug 27, that the cleaning solution inlet pipe 21 is made of fluorine resin, and that the end of the inlet pipe 21 projects and faces near to the opposite inside wall of the container 20.

In the trap device thus constructed, the cleaning solution introduced by the drain pipe 1 into the container 20 strikes against the inside wall 24 of the container 20 when it is discharged from the end of the inlet pipe 21, and flows down calmly along the inside wall face 24 of the container 20 and to the bottom of the container 20 to limit the bubbling of the stored cleaning solution.

As the below-described embodiments show, the bubbles produced in the trap device according to the present invention are small in size, compared with those in the conventional trap units comprising a cleaning solution inlet pipe of any other material than fluorine resin. The small size of bubble has an effect of suppressing the production of liquid film due to bubbling and consequently the sucking-up of liquid film as caused in the interiors of the conventional containers.

However, the liquid film may be produced in this embodiment, even if it is considerably smaller than those in the conventional trap units. If a liquid film is formed, the baffle plates 25 provided in the interior of the container 20 destroy the liquid film being sucked upward, so that the liquid film cannot reach the opening of the air suction pipe 23 at the top of the container 20.

The cleaning solution drain piping system comprising the trap device according to the present invention can be operated in the same way as the conventional type of system.

EXAMPLES 1 AND 2:

Cleaning solution drain tests were conducted by using a cleaning solution drain piping system comprising the trap device according to the present invention as shown in the drawings annexed hereto. The sizes and materials used for the components of the container as the body of the trap device are as listed below. The cleaning solutions contained non-ionic surfactant of polyoxyethylene (10) octylphenyl ether in the concentrations of 0.05%, 0.01%, and 0.001%, respectively. About 31 ml of the cleaning solution was introduced into the trap device by using a cup containing 1.25 ml of the cleaning solution.

| | |
|---|---|
| Container body: Cylindrical type, | |
| inside diameter | 40 mm |
| height | 125 mm |
| Negative pressure in the interior of the container | 0.5 bars |
| Mounting height of cleaning solution inlet pipe 21 From the bottom of the container | 65 mm |
| Cleaning solution inlet pipe 21 | |
| Example 1 Ethylene tetrafluoride resin (by Flon Industry Co., Ltd.) | |
| Example 2 Ethylene chloride trifluoride resin (by Flon Industry Co., Ltd.): | |
| Inside diameter of pipe | 1 mm |
| Pipe length | 10 mm |
| Distance from the faced inside wall face | Approx. 20 mm |
| Mounting height of baffle plates (to the tops of the inclined plates) | |
| From top of the container | 20 mm |
| | 40 mm |
| Inclination | 15° |

The tests were made in the above-described conditions, and the heights where bubbles were produced in the container were measured. The results are as shown in Table 1 below.

COMPARISON 1

Tests were conducted in the same conditions as for Embodiments 1 and 2, except that the cleaning solution inlet pipe 21 was a stainless steel pipe (inside diameter 1 mm). The results are as shown in Table 1 below.

TABLE 1

| concentration of non-ionic surfactants | 0.05% | 0.01% | 0.001% |
|---|---|---|---|
| Example 1 (mm in approx.) | 30 (26) | 14 (26) | 1 (28) |
| Example 2 (mm in approx.) | 30 (26) | 20 (26) | 5 (28) |
| Comparison 1 (mm in approx.) Min. | 80 (26) | 20 (26) | 7 (28) |

Note: Each figure in the parentheses ( ) in TABLE 1 represents the height to the bottom of the produced foam layer.

EXAMPLES 3 AND 4

Tests were made in the same conditions as for Examples 1 and 2, except that the cleaning solutions were non-ionic surfactants of polyoxyethylene sorbitane monolaurate in the concentrations of 0.025%, 0.05% and 0.1%. The results are shown in Table 2 below. The solution inlet pipe 21 was of ethylene tetrafluoride resin for Example 3 and of ethylene chloride trifluoride resin for Example 4.

COMPARISON 2

Tests were made in the same conditions as for Examples 3 and 4, except that the cleaning solution inlet pipe 21 was a stainless steel pipe (inside diameter 3 mm). The results are as shown in Table 2.

TABLE 2

| concentration of non-ionic surfactants | 0.025% | 0.05% | 0.1% |
|---|---|---|---|
| Example 3 (mm in approx.) | 15 (26) | 25 (26) | 40 (26) |
| Example 4 (mm in approx.) | 15 (26) | 25 (26) | 40 (26) |
| Comparison 2 (mm in approx.) | 20 (26) | 40 (26) | Min. 80 (26) |

Note: Each figure in the parentheses ( ) in TABLE 2 represents the height to the bottom of the produced foam layer.

EXAMPLE 5

Tests were performed under the following conditions.

| | |
|---|---|
| Cleaning solution inlet pipe: made of ethylene tetrafluoride resin (by Flon Industry Co., Ltd.) was used. | |
| Inside diameter of pipe: | 0.5, 1.0, 1.6, 2.0 (mm) |
| Pipe length: | 5 mm |
| Negative pressure in the interior of the container: | 0.6 bars |
| Cleaning solution: polyoxyethylene sorbitane mono-laurate | 0.01% |

Results

| Inside diameter of pipe (mm) | 0.5 | 1.0 | 1.6 | 2.0 |
|---|---|---|---|---|
| Bubble height (mm in approx.) | 11 (35) | 9 (35) | 11 (35) | 14 (35) |

The figures in the parentheses represent the same as herein before.

EXAMPLE 6

Tests were conducted under the same conditions as in Example 5 except that the inlet pipe length was 10 mm.

| Results | | | | |
|---|---|---|---|---|
| Inside diameter of pipe (mm) | 0.5 | 1.0 | 1.6 | 2.0 |
| Bubble height (mm in approx.) | 11 (35) | 9 (35) | 11 (35) | 14 (35) |

The figures in parentheses represent the same as herein before.

In Examples 5 and 6, the cleaning solution was introduced 25 times each being 1.8 ml. Thus $1.8 \times 25 = 45$ ml.

These test results show that the embodiments according to the present invention provided lower rates of bubbling and that they had little possibility of cleaning solutions entering into the air suction pipes 23 during the long and continuous operations.

As it has been described above, the liquid drain trap device according to the present invention has the advantageous effects that it can prevent any bubbling on the surface of the liquid such as cleaning solution introduced in the interior of the container and consequently reduce largely the possibility of the cleaning solution in the trap container entering into the air suction system (especially the vacuum tank), and that even if the cleaning solution is bubbled in the interior of said container, the limiting part provided in the interior of said container to decrease the horizontal section area of the container interior space can destroy and liquid film formed on the surface of the cleaning solution so as to prevent the cleaning solution effectively from entering into the air suction system (especially the vacuum tank). In comparison with the conventional trap units, the liquid drain trap device according to the present invention is also very useful, because the use of said trap device permits the long and continuous operation of any biochemical or chemical reaction analysis processing system with no need of drainage from vacuum tank.

What is claimed is:

1. A negative-pressure relay type liquid drain trap device for use in a biochemical analysis system, said trap comprising a vertically-elongated hollow container, a liquid drain pipe connected to the side wall of said container having an end section projecting into the interior of said container and negative-pressure suction means provided in an upper side of said container so as to maintain the interior of said container under a negative pressure and exert a suction force to drain a liquid from another container through said pipe into the container, said liquid drain pipe being made of fluorine resin material at least at said end section projecting into the interior of said container so as to substantially prevent the formation of foam in the liquid being drained through said pipe.

2. A liquid drain trap device according to claim 1, which further comprises a baffle plate located inside the container at a position above said end section of the liquid drain pipe.

3. A liquid drain trap device according to claim 2, wherein the baffle plate is made of fluorine resin material.

4. A liquid drain trap device according to any of claims 1 to 3, wherein the fluorine resin material is selected from the group consisting of ethylene tetrafluoride, ethylene trifluoride, copolymer of ethylene tetrafluoride and propylene hexafluoride, and polymer of vinylidene fluoride.

* * * * *